US012760735B2

(12) United States Patent
Hamada

(10) Patent No.: US 12,760,735 B2
(45) Date of Patent: Oct. 13, 2026

(54) HERMETIC COMPRESSOR AND REFRIGERATION CYCLE APPARATUS

(71) Applicant: Mitsubishi Electric Corporation, Tokyo (JP)

(72) Inventor: Ryo Hamada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 19/146,658

(22) PCT Filed: Mar. 14, 2023

(86) PCT No.: PCT/JP2023/009874
§ 371 (c)(1),
(2) Date: Jul. 9, 2025

(87) PCT Pub. No.: WO2024/189777
PCT Pub. Date: Sep. 19, 2024

(65) Prior Publication Data
US 2026/0218707 A1 Jul. 30, 2026

(51) Int. Cl.
*F04C 29/12* (2006.01)
*F04C 18/48* (2006.01)
*F25B 31/02* (2006.01)

(52) U.S. Cl.
CPC ..... *F04C 29/12* (2013.01); *F04C 18/48* (2013.01); *F25B 31/026* (2013.01); *F04C 2240/40* (2013.01)

(58) Field of Classification Search
CPC ..... F04C 29/12; F04C 18/48; F04C 2240/40; F04C 18/3564; F04C 23/001; F04C 23/008; F25B 31/026
(Continued)

(56) References Cited

U.S. PATENT DOCUMENTS 9,909,587 B2 * 3/2018 Yang ..... F04C 29/128
2012/0174618 A1 * 7/2012 Ogata ..... F04C 18/3564 418/268
2012/0174619 A1 * 7/2012 Ogata ..... F04C 18/324 418/209

FOREIGN PATENT DOCUMENTS

CN 104806522 A 7/2015
EP 3783225 A1 2/2021
(Continued)

OTHER PUBLICATIONS

Office Action dated Feb. 24, 2026 issued in corresponding JP patent application No. 2025-506319 (and English translation).
(Continued)

*Primary Examiner* — Mark A Laurenzi
*Assistant Examiner* — Benjamin Doyle
(74) *Attorney, Agent, or Firm* — Posz Law Group, PLC

(57) ABSTRACT

A hermetic compressor includes: a cylinder including a compression chamber, an injection vertical hole, and a communicating part, and closing parts fixed to both end surfaces of the cylinder in the height direction to close the compression chamber, wherein the closing part that is fixed to one end surface of the cylinder has a discharge port through which the refrigerant compressed is discharged to the outside of the compression chamber and, in a plan view, a straight line connecting a center of the injection vertical hole and a center of a boundary part between the communicating part and an inner periphery of the cylinder passes through a region obtained by projecting the discharge port in the height direction of the cylinder.

6 Claims, 11 Drawing Sheets

(58) Field of Classification Search
USPC ..... 417/410.3; 62/498; 418/209, 268
See application file for complete search history.

(56) References Cited

FOREIGN PATENT DOCUMENTS

| | | | |
|---|---|---|---|
| JP | 2012-107568 | A | 6/2012 |
| JP | 2019-167839 | A | 10/2019 |
| WO | 2013/061606 | A1 | 5/2013 |

OTHER PUBLICATIONS

International Search Report of the International Searching Authority dated May 16, 2023 for the corresponding International Application No. PCT/JP2023/009874 (and English translation).

* cited by examiner

HERMETIC COMPRESSOR AND REFRIGERATION CYCLE APPARATUS

CROSS-REFERENCE TO RELATED APPLICATION

This application is a U.S. national stage application of PCT/JP2023/009874 filed on Mar. 14, 2023, the contents of which are incorporated herein by reference.

TECHNICAL FIELD

The present disclosure relates to a hermetic compressor including an injection mechanism, and to a refrigeration cycle apparatus.

BACKGROUND ART

In a conventional hermetic compressor, a motor constituted of a rotor and a stator is mounted in the upper part of a hermetic container, and rotation of the motor is transmitted to a machine part, which is disposed below the motor, by a crankshaft fixed to this rotor. The machine part is mainly constituted of a cylinder, a main bearing, a sub-bearing, an intermediate plate, and a piston. The rotation of the crankshaft having an eccentric shape causes eccentric rotation of the piston and hence, the volume of a compression chamber is reduced, so that refrigerant is compressed.

An injection hole is formed in any one component or a plurality of components selected from the main bearing, the sub-bearing, and the intermediate plate in such a way as to communicate with the compression chamber, and intermediate-pressure liquid refrigerant or intermediate-pressure gas refrigerant is injected into the compression chamber from an injection pipe pressed in or welded to the injection hole. By adding this injection refrigerant, the flow rate of refrigerant discharged from a rotary compressor is increased, leading to an increase in capacity of the refrigeration cycle. A compression mechanism part is cooled by the injection refrigerant and hence, a failure of the compressor can be suppressed, leading to an increase in reliability. To reduce deterioration in efficiency of a compressor caused by backflow of compressed refrigerant to an injection flow passage, there is a compressor in which a check valve is provided in the intermediate portion of the injection flow passage (see Patent Literature 1, for example).

CITATION LIST

Patent Literature

Patent Literature 1: Japanese Unexamined Patent Application Publication No. 2019-190302

SUMMARY OF INVENTION

Technical Problem

In the hermetic compressor disclosed in Patent Literature 1 and having the injection mechanism that injects intermediate-pressure refrigerant into the compression chamber as injection refrigerant, portions that are cooled by the injection refrigerant and portions heated by compressed high-temperature-and-high-pressure refrigerant are unevenly distributed in the compression mechanism part. Thus there is a problem that when the portions heated by the compressed high-temperature-and-high-pressure refrigerant are not cooled, and are superheated, such superheating becomes a cause of failure of the compressor and hence, reliability is deteriorated.

The present disclosure has been made to solve the above-mentioned problem, and it is an object of the present disclosure to provide a hermetic compressor and a refrigeration cycle apparatus that can suppress deterioration in reliability.

Solution to Problem

A hermetic compressor according to one embodiment of the present disclosure includes: a cylinder including a compression chamber, an injection vertical hole, and a communicating part, refrigerant being compressed in the compression chamber, the injection vertical hole extending in a height direction and constituting a portion of an injection flow passage through which the refrigerant is supplied into the compression chamber, the communicating part being configured to make the injection vertical hole and the compression chamber communicate with each other; and closing parts fixed to both end surfaces of the cylinder in the height direction to close the compression chamber, wherein a closing part of the closing parts that is fixed to one end surface of both end surfaces of the cylinder has a discharge port through which the refrigerant compressed is discharged to an outside of the compression chamber, and in a plan view, a straight line passes through a region obtained by projecting the discharge port in the height direction of the cylinder, the straight line connecting a center of the injection vertical hole and a center of a boundary part between the communicating part and an inner periphery of the cylinder.

A hermetic compressor according to another embodiment of the present disclosure includes: an electric motor including a stator and a rotor; a cylinder including a compression chamber, an injection vertical hole, and a communicating part, refrigerant being compressed in the compression chamber, the injection vertical hole extending in a height direction and constituting a portion of an injection flow passage through which the refrigerant is supplied into the compression chamber, the communicating part being configured to make the injection vertical hole and the compression chamber communicate with each other; a rotary shaft provided in the compression chamber, including an eccentric shaft part, and configured to be rotated by the electric motor, the eccentric shaft part being configured to perform an eccentric motion in the compression chamber; a rolling piston provided to the eccentric shaft part; a vane configured to partition a space formed by an inner periphery of the cylinder and an outer periphery of the rolling piston into a suction-side space and a compression-side space; and closing parts fixed to both end surfaces of the cylinder in the height direction to close the compression chamber, wherein a closing part of the closing parts that is fixed to one end surface of both end surfaces of the cylinder has a discharge port through which the refrigerant compressed is discharged to an outside of the compression chamber, and in a phase of the rolling piston in which a pressure of refrigerant in the compression chamber matches a pressure of refrigerant discharged from the discharge port, in a plan view, a straight line passes through a region formed by the inner periphery of the cylinder, the outer periphery of the rolling piston, and the vane, the straight line connecting a center of the injection vertical hole and a center of a boundary part between the communicating part and the inner periphery of the cylinder.

Alternatively, a hermetic compressor according to still another embodiment of the present disclosure includes: a cylinder including a compression chamber, an injection vertical hole, and a communicating part, refrigerant being compressed in the compression chamber, the injection vertical hole extending in a height direction and constituting a portion of an injection flow passage through which the refrigerant is supplied into the compression chamber, the communicating part being configured to make the injection vertical hole and the compression chamber communicate with each other; and closing parts fixed to both end surfaces of the cylinder in the height direction to close the compression chamber, wherein a closing part of the closing parts that is fixed to one end surface of both end surfaces of the cylinder has a discharge port through which the refrigerant compressed is discharged to an outside of the compression chamber, a discharge cutout is formed by cutting out a portion of the one end surface of the cylinder at a position close to an inner periphery of the cylinder, and in a case in which the communicating part and the discharge cutout are disposed at positions that at least partially overlap with each other when the communicating part and the discharge cutout are projected on a same plane in the height direction, in a plan view, a straight line passes through a region obtained by projecting the discharge cutout in the height direction of the cylinder, the straight line connecting a center of the injection vertical hole and a center of a boundary part between the communicating part and the inner periphery of the cylinder.

A refrigeration cycle apparatus according to still another embodiment of the present disclosure includes the above-mentioned hermetic compressor.

Advantageous Effects of Invention

According to the hermetic compressor and the refrigeration cycle apparatus according to the embodiment of the present disclosure, the cylinder includes the injection vertical hole, which forms a portion of the injection flow passage, and the communicating part and, in a plan view, the straight line passes through the region obtained by projecting the discharge port in the height direction of the cylinder, the straight line connecting the center of the injection vertical hole and the center of the boundary part between the communicating part and the inner periphery of the cylinder, or the straight line passes through the region formed by the inner periphery of the cylinder, the outer periphery of the rolling piston, and the vane in a phase of the rolling piston in which the pressure of refrigerant in the compression chamber matches the pressure of refrigerant discharged from the discharge port, or the straight line passes through the region obtained by projecting the discharge cutout in the height direction of the cylinder in a case in which the communicating part and the discharge cutout are disposed at positions that at least partially overlap with each other when the communicating part and the discharge cutout are projected on the same plane in the height direction. The injection vertical hole and the communicating part are disposed as described above and hence, relatively-low-temperature injection refrigerant passes through a high-temperature portion in a region that is heated to a high temperature by the compressed high-temperature-and-high-pressure refrigerant, so that the high-temperature portion is cooled. As a result, superheating of the high-temperature portion is suppressed and hence, deterioration in reliability can be suppressed.

DESCRIPTION OF EMBODIMENTS

Hereinafter, Embodiment of the present disclosure will be described with reference to the drawings. The present disclosure is not limited by Embodiment described below. In addition, the relationship of sizes of respective components in the following drawings may differ from that of the actual ones.

EMBODIMENT

Figure 1:
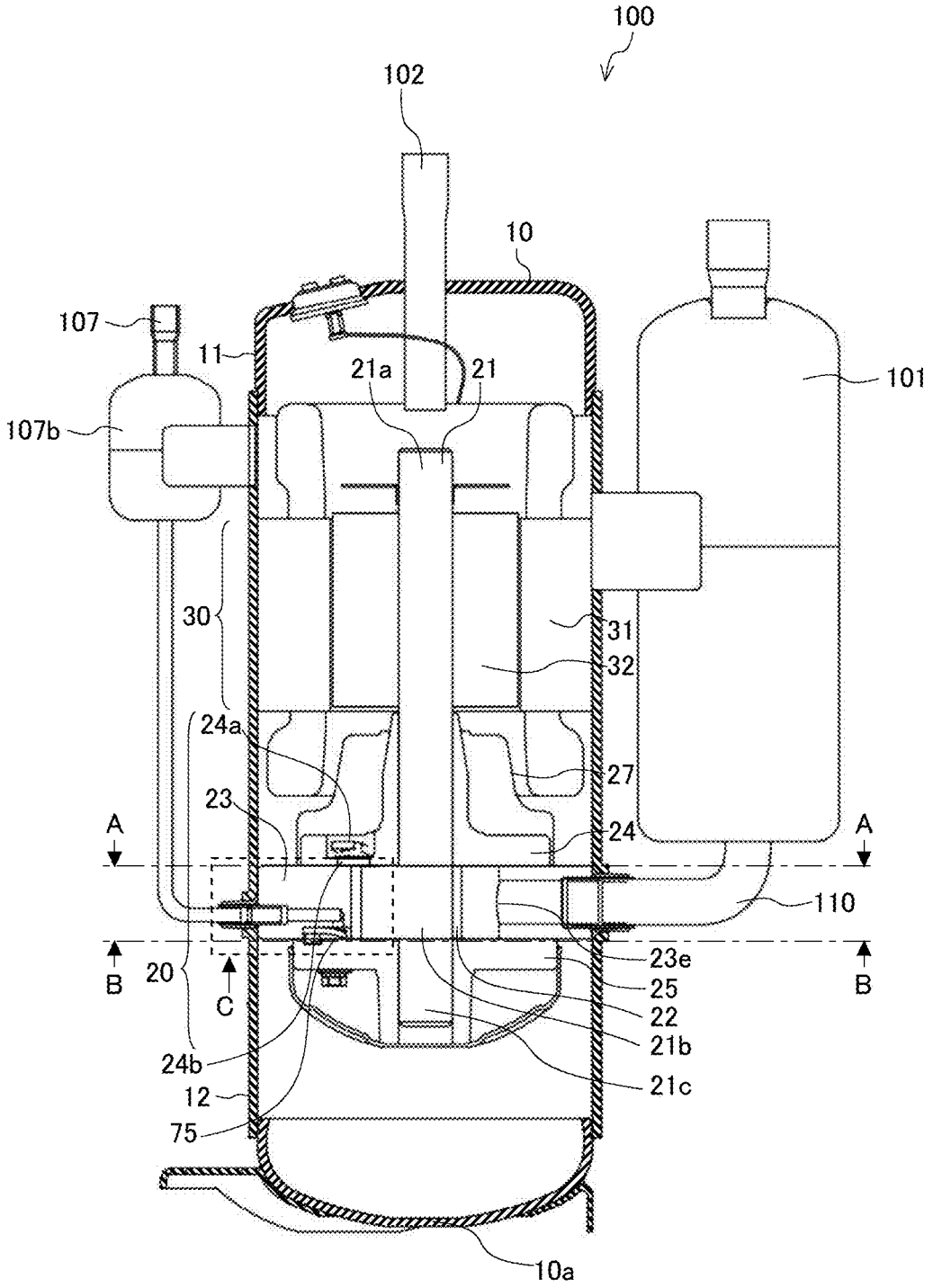
FIG. 1 is a schematic view showing a longitudinal cross section of a hermetic compressor according to Embodiment.
Figure 2:
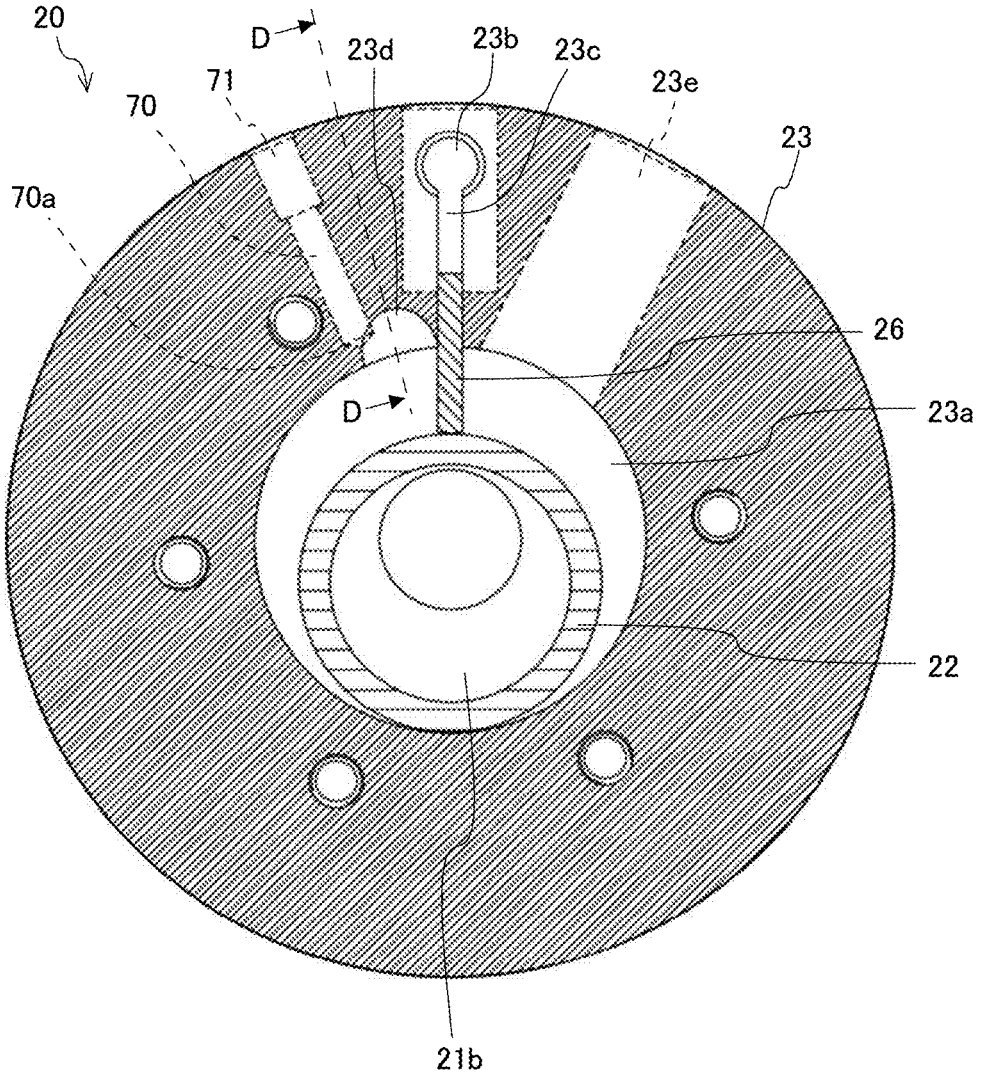
FIG. 2 is a schematic plan view of a compression mechanism part as viewed in the direction of arrows when the hermetic compressor shown in FIG. 1 is taken along A-A.
Figure 3:
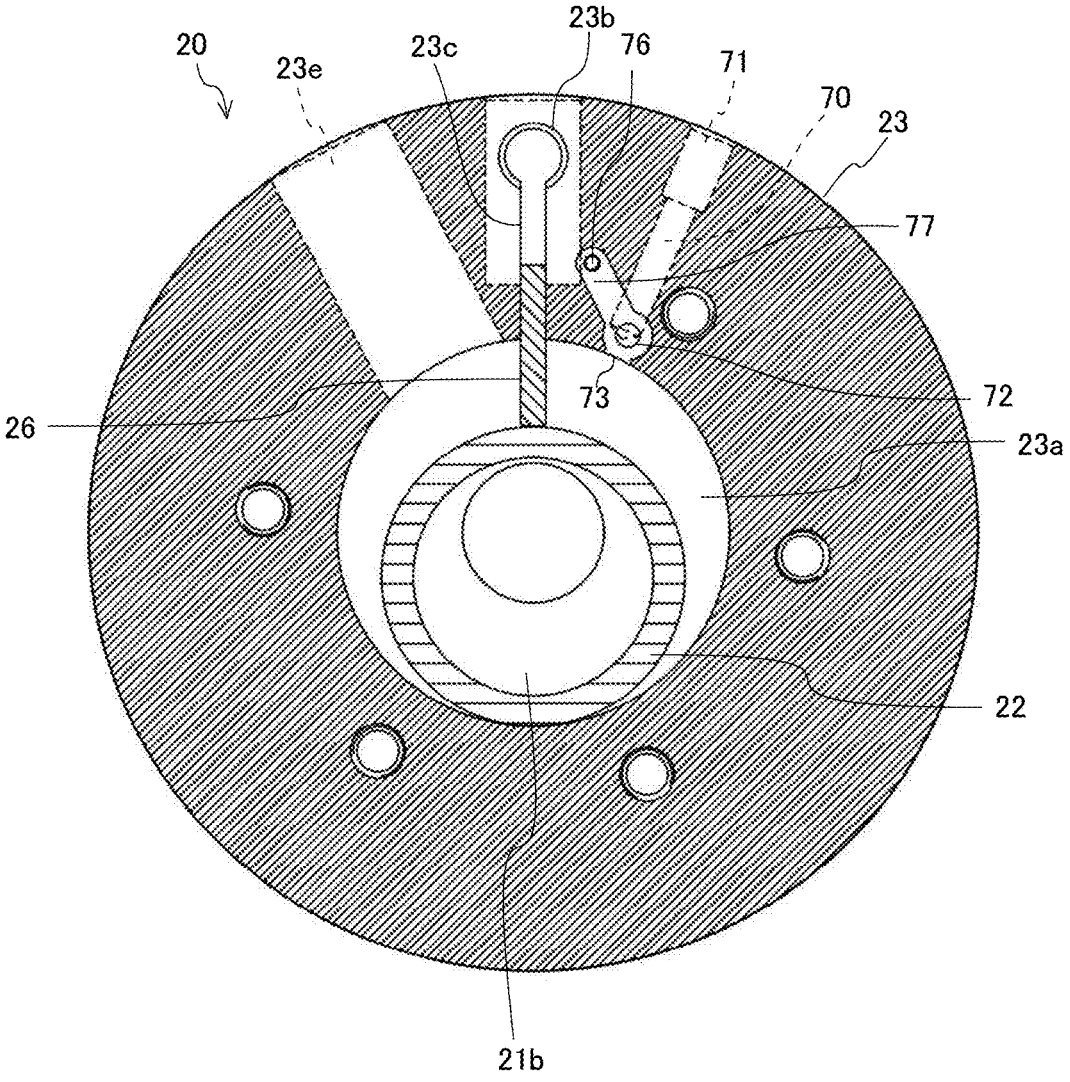
FIG. 3 is a schematic plan view of the compression mechanism part as viewed in the direction of arrows when the hermetic compressor shown in FIG. 1 is taken along B-B.
Figure 4:
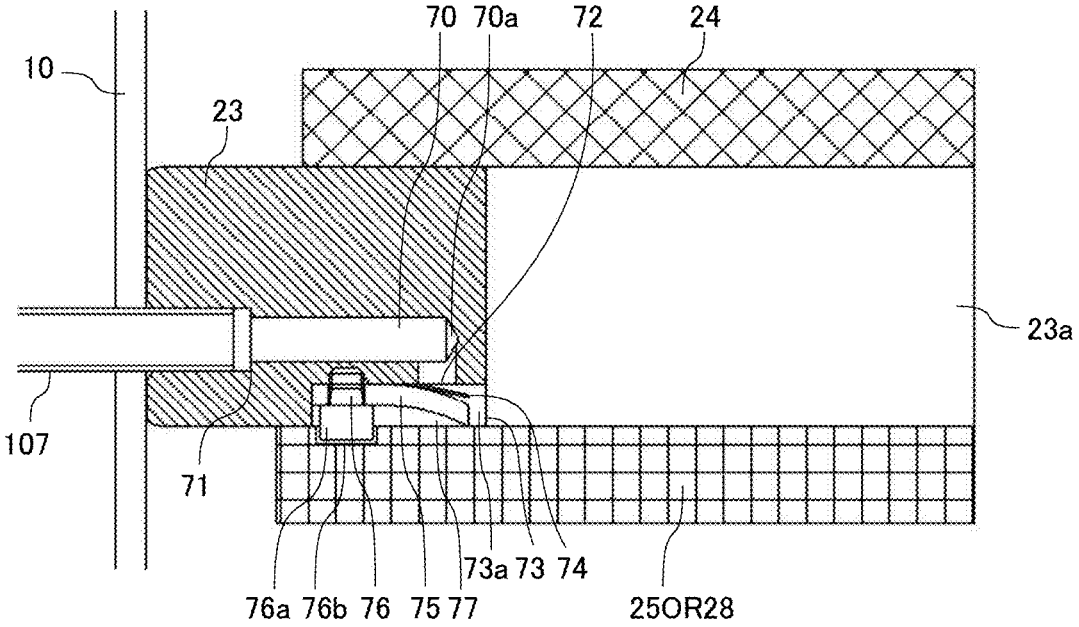
FIG. 4 is a schematic view showing, in an enlarged manner, a portion of the hermetic compressor shown in FIG. 1 by an arrow C.
Figure 5:
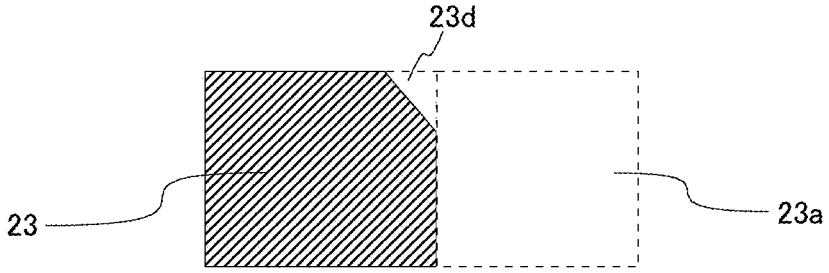
FIG. 5 is a longitudinal cross-sectional schematic view of a cylinder as viewed in the direction of arrows when compression mechanism part shown in FIG. 2 is taken along D-D.
Figure 6:
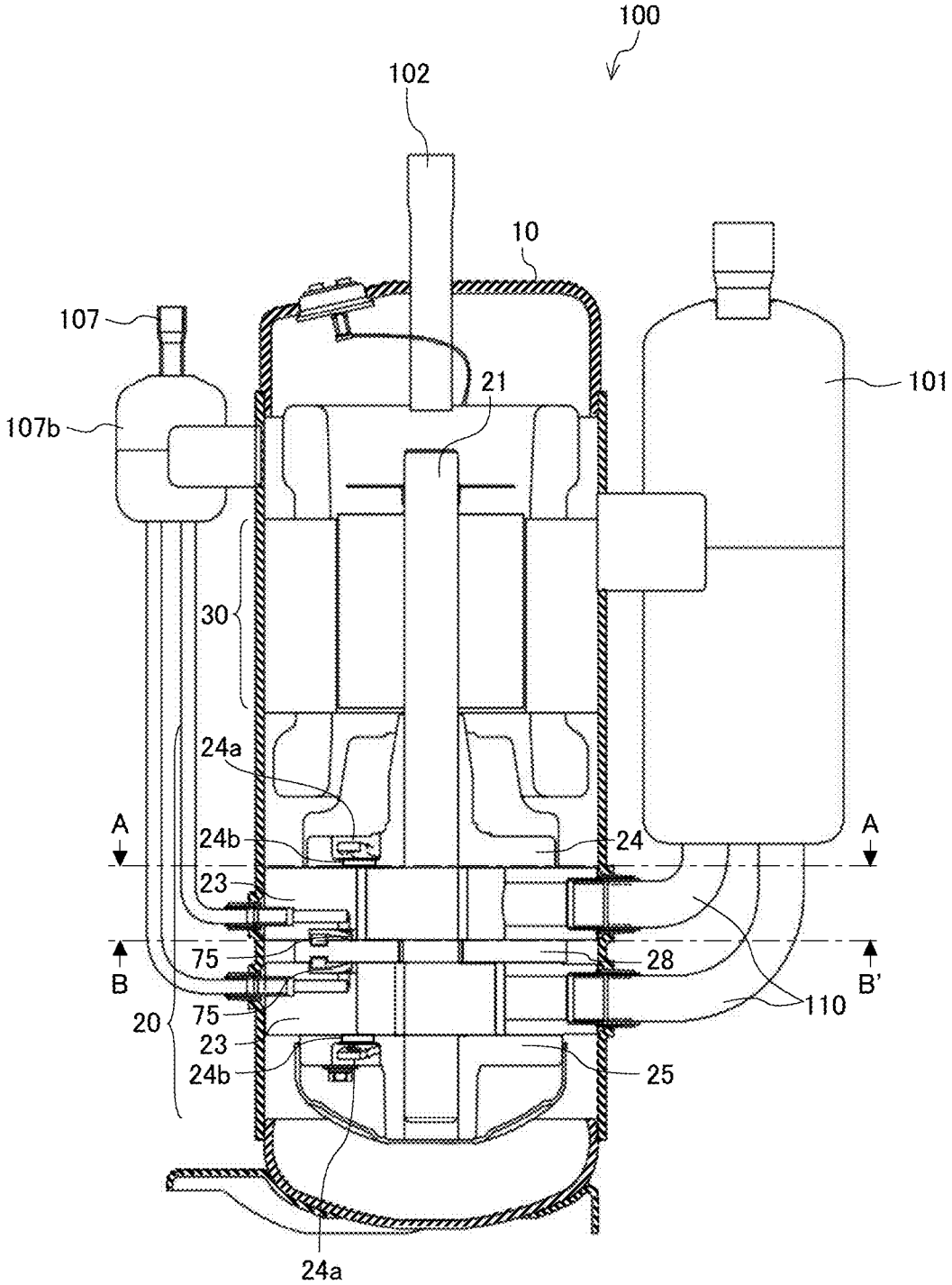
FIG. 6 is a schematic view showing a longitudinal cross section of a modification of the hermetic compressor according to Embodiment.

FIG. 1 is a schematic view showing the longitudinal cross section of a hermetic compressor 100 according to Embodiment. FIG. 2 is a schematic plan view of a compression mechanism part 20 as viewed in the direction of arrows when the hermetic compressor 100 shown in FIG. 1 is taken along A-A. FIG. 3 is a schematic plan view of the compression mechanism part 20 as viewed in the direction of arrows when the hermetic compressor 100 shown in FIG. 1 is taken along B-B. FIG. 4 is a schematic view showing, in an enlarged manner, a portion of the hermetic compressor 100 shown in FIG. 1 by an arrow C. FIG. 5 is a longitudinal cross-sectional schematic view of a cylinder 23 as viewed in the direction of arrows when the compression mechanism part 20 shown in FIG. 2 is taken along D-D. FIG. 6 is a schematic view showing a longitudinal cross section of a modification of the hermetic compressor 100 according to Embodiment.

For the hermetic compressor 100 according to Embodiment, a one-cylinder rotary compressor including one cylinder 23 and shown in FIG. 1, that is, a single rotary compressor, is used. Hereinafter, the overall configuration of the hermetic compressor 100, which is a single rotary compressor, will be described.

As shown in FIG. 1, the hermetic compressor 100 includes the compression mechanism part 20 and an electric motor 30 in a hermetic container 10, the compression mechanism part 20 compressing refrigerant gas, the electric motor 30 driving the compression mechanism part 20. The hermetic container 10 is constituted of an upper container 11 and a lower container 12. The compression mechanism part 20 is housed in the lower part of the hermetic container 10, and the electric motor 30 is housed in the upper part of the hermetic container 10. The electric motor 30 is constituted of a stator 31 and a rotor 32. The compression mechanism part 20 and the electric motor 30 are coupled to each other by a rotary shaft 21 extending in the up-down direction. The rotary shaft 21 transmits a rotational motion of the electric motor 30 to the compression mechanism part 20, and refrigerant gas is compressed in the compression mechanism part 20 by the transmitted rotational force, and is discharged into the hermetic container 10. The inside of the hermetic container 10 is filled with the compressed high-temperature-and-high-pressure refrigerant gas, and refrigerating machine oil for lubrication of the compression mechanism part 20 is stored in a bottom part 10*a* of the hermetic container 10. An oil pump not shown in the drawing is provided at the lower part of the rotary shaft 21. The oil pump pumps up the refrigerating machine oil, which is stored in the bottom part 10*a* of the hermetic container 10, with the rotation of the rotary shaft 21, and supplies the refrigerating machine oil to the respective sliding parts of the compression mechanism part 20. Consequently, the mechanical lubricating action of the compression mechanism part 20 is ensured.

The rotary shaft 21 is constituted of a main shaft part 21*a*, an eccentric shaft part 21*b*, and a sub-shaft part 21*c*, and the main shaft part 21*a*, the eccentric shaft part 21*b*, and the sub-shaft part 21*c* are arranged in this order from top to bottom in the axial direction. The electric motor 30 is shrink-fitted or press-fitted on and fixed to the main shaft part 21*a*, and a rolling piston 22 having a cylindrical shape is slidably fitted on the eccentric shaft part 21*b*.

As shown in FIG. 1 to FIG. 3, the compression mechanism part 20 includes the rolling piston 22, the cylinder 23, an upper bearing 24, a lower bearing 25, and a vane 26. A compression chamber 23*a* is formed in the cylinder 23, the compression chamber 23*a* being a cylindrical space having both ends in the axial direction open. The eccentric shaft part 21*b* of the rotary shaft 21, the rolling piston 22, and the vane 26 are housed in the compression chamber 23*a*, the eccentric shaft part 21*b* of the rotary shaft 21 performing the eccentric motion in the compression chamber 23*a*, the rolling piston 22 being fitted on the eccentric shaft part 21*b*, the vane 26 partitioning a space formed by the inner periphery of the cylinder 23 and the outer periphery of the rolling piston 22 into a suction-side space and a compression-side space, refrigerant being suctioned into the suction-side space, the refrigerant being compressed in the compression-side space.

A vane groove 23*c* extending in the radial direction is formed in the cylinder 23 in a penetrating manner in the axial direction. One end side of the vane groove 23*c* in the radial direction is open to the compression chamber 23*a*, and a back pressure chamber 23*b* is formed on the other end side of the vane groove 23*c* in the radial direction. The vane 26 is housed in the vane groove 23*c*. The vane 26 reciprocates in the radial direction in the vane groove 23*c*. The vane 26 has, in a state of being attached to the vane groove 23*c*, a substantially cuboid shape having a thickness in the circumferential direction of the compression chamber 23*a* smaller than the length of the vane 26 in the radial direction of the compression chamber 23*a* and the length of the vane 26 in the axial direction of the compression chamber 23*a*. A vane spring not shown in the drawing is provided to the back pressure chamber 23*b* of the vane groove 23*c*.

Usually, high-pressure refrigerant gas in the hermetic container 10 flows into the back pressure chamber 23*b*, and a force that moves the vane 26 in the radial direction toward the center of the compression chamber 23*a* is generated by a differential pressure between the pressure of the refrigerant gas in the back pressure chamber 23*b* and the pressure of refrigerant gas in the compression chamber 23*a*. The vane 26 is moved in the radial direction toward the center of the compression chamber 23*a* by this force generated by the differential pressure between the pressure of the refrigerant gas in the back pressure chamber 23*b* and the pressure of refrigerant gas in the compression chamber 23*a* and by a force that the vane spring pushes the vane 26 in the radial direction. The force that moves the vane 26 in the radial direction causes one end of the vane 26, that is, the end part of the vane 26 on the compression chamber 23*a* side, to come into contact with the cylindrical outer periphery of the rolling piston 22. This contact can provide a partition to the space formed by the inner periphery of the cylinder 23 and the outer periphery of the rolling piston 22. Even when a differential pressure between the pressure of refrigerant gas in the hermetic container 10, that is, the pressure of refrigerant gas in the back pressure chamber 23*b*, and the pressure of refrigerant gas in the compression chamber 23*a* is not sufficient to push the vane 26 against the outer periphery of the rolling piston 22, it is possible to cause the one end of the vane 26 to be pushed against the outer periphery of the rolling piston 22 by the force of the vane spring. Therefore, it is possible to allow the one end of the vane 26 to be always in contact with the outer periphery of the rolling piston 22.

As shown in FIG. 1, the upper bearing 24 has a substantially inverted T shape when viewed from the side, is fitted on the main shaft part 21*a* of the rotary shaft 21 to rotatably support the main shaft part 21*a*, and closes one opening port of the compression chamber 23*a* in the axial direction. In the same manner, the lower bearing 25 has a substantially T shape when viewed from the side, is fitted on the sub-shaft part 21*c* of the rotary shaft 21 to rotatably support the sub-shaft part 21*c*, and closes the other opening port of the compression chamber 23*a* in the axial direction. The upper bearing 24 has a discharge port 24*b* through which refrigerant gas compressed in the compression chamber 23*a* is discharged to the outside of the compression chamber 23*a*. As shown in FIG. 2, the cylinder 23 has a suction port 23*e* through which low-pressure refrigerant gas is suctioned into the compression chamber 23*a* from the outside of the hermetic container 10. As shown in FIG. 2 and FIG. 5, the cylinder 23 has a discharge cutout 23*d* to prevent rapid shrinkage or bending of a refrigerant flow passage that communicates with the discharge port 24*b*. This discharge cutout 23*d* is formed by cutting out a portion of the upper end surface of the cylinder 23 at a position close to the inner periphery.

As shown in FIG. 1, the upper bearing 24 is provided with a long-shaped discharge valve 24*a* that closes or opens the discharge port 24*b*. A part to be fixed that is fixed by a fixing part not shown in the drawing is provided on one end side of the discharge valve 24*a*, and a circular head part that closes or opens the discharge port 24*b* is provided on the other end side of the discharge valve 24*a*. The discharge valve 24*a* is an opening and closing valve that lifts in the upper bearing 24 to act as a leaf spring, and the head part of the discharge valve 24*a* closes or opens the discharge port 24*b*. With such an operation, a discharge timing of high-temperature-and-high-pressure refrigerant gas to be discharged from the inside of the compression chamber 23*a* to the outside via the discharge port 24*b* is controlled. That is, the discharge valve 24*a* closes the discharge port 24*b* by the head part thereof until refrigerant gas compressed in the compression chamber 23*a* of the cylinder 23 reaches a predetermined pressure and, when the refrigerant gas increases above the predetermined pressure, the discharge valve 24*a* opens the discharge port 24*b* to discharge the high-temperature-and-high-pressure refrigerant gas to the outside of the compression chamber 23*a*. The upper bearing 24 is also referred to as "closing part".

For the hermetic compressor 100 according to Embodiment, a rotary compressor including a plurality of cylinders 23 may be used instead of the above-mentioned single rotary compressor. In the case of a twin rotary compressor including two cylinders 23 as shown in FIG. 6, a compression mechanism part 20 includes an intermediate plate 28 in addition to the above-mentioned rolling piston 22, cylinders 23, upper bearing 24, lower bearing 25, and vane 26, and a lower bearing 25 is also provided with a discharge port 24*b* and a discharge valve 24*a* in the same manner as the upper bearing 24. In this case, each of the upper bearing 24 and the lower bearing 25 is also referred to as "closing part". Each of the two cylinders 23 has the suction port 23*e*. That is, one cylinder 23 has one suction port 23*e* and one discharge port 24*b*.

As shown in FIG. 2 to FIG. 4, the cylinder 23 has an injection lateral hole 70 extending in the radial direction, and an injection pipe connection part 71 that communicates with the injection lateral hole 70 is formed outward of the injection lateral hole 70 in the radial direction. An injection pipe 107 is connected to the injection pipe connection part 71. The cylinder 23 also has an injection vertical hole 72 extending in the height direction (or the axial direction), and the injection vertical hole 72 is formed in the vicinity of the distal end of the injection lateral hole 70 on the inner side in the radial direction. Hereinafter, the injection lateral hole 70 and the injection vertical hole 72 are collectively referred to as "injection hole". This injection hole constitutes a portion of an injection flow passage through which injection refrigerant flowing into the compression chamber 23*a* from the injection pipe 107 flows. The end part of the injection lateral hole 70 on the compression chamber 23*a* side is located closer to the outer periphery of the cylinder 23 than the inner periphery of the cylinder 23 does, so that the injection lateral hole 70 is separated from the compression chamber 23*a*. Therefore, the injection lateral hole 70 is not in communication with the compression chamber 23*a*. A distal end hole 70*a* having a conical shape is formed at the distal end of the injection lateral hole 70 on the inner side in the radial direction. One end surface of the cylinder 23 in the height direction has an injection-check-valve actuation groove 77 at a position close to the inner periphery of the cylinder 23. The side of this injection-check-valve actuation groove 77 close to the inner periphery of the cylinder 23 is open toward the center of the cylinder 23. One end side of the injection vertical hole 72 in the axial direction communicates with the injection lateral hole 70, and the other end side of the injection vertical hole 72 communicates with the injection-check-valve actuation groove 77. That is, the injection vertical hole 72 reaches one end surface of the cylinder 23 in the height direction. The injection vertical hole 72 may communicate with the distal end hole 70*a*. If the injection vertical hole 72 is not in communication with the distal end hole 70*a*, it is necessary to dispose the injection vertical hole 72 at a position close to the outer periphery of the cylinder 23, so that restrictions are imposed on the arrangement of an injection check valve 74. However, by making the injection vertical hole 72 communicate with the distal end hole 70*a*, it is possible to dispose the injection vertical hole 72 at a position close to the center of the cylinder 23 and hence, it is possible to reduce restrictions on the arrangement of the injection check valve 74.

The long-shaped injection check valve 74 and a long-shaped injection-check-valve-lift-amount control plate 75 are provided in the injection-check-valve actuation groove 77. The part to be fixed that is fixed by a fixing part 76 described later is provided on one end side of the injection check valve 74, and a circular head part that closes or opens the injection vertical hole 72 is provided on the other end side of the injection check valve 74. The injection check valve 74 is an opening and closing valve that lifts in the injection-check-valve actuation groove 77 to act as a leaf spring, and the head part of the injection check valve 74 closes or opens the injection vertical hole 72. With such an operation, an injection timing of injection refrigerant that flows into the compression chamber 23*a* from the injection pipe 107 via the injection hole is controlled. The injection-check-valve-lift-amount control plate 75 is provided to the injection check valve 74 on the side opposite to the injection vertical hole 72 to limit the lift amount of the injection check valve 74.

The injection check valve 74 and the injection-check-valve-lift-amount control plate 75 are fixed to one end surface of the cylinder 23 in the height direction by the fixing part 76. The fixing part 76 is, for example, a bolt and, as shown in FIG. 4, a head part 76*a* of the fixing part 76 protrudes outward from the end surface of the cylinder 23 in the height direction. The protruding head part 76*a* is housed in a housing hole 76*b*, and the housing hole 76*b* is provided to the lower bearing 25 in the case of a single rotary compressor, whereas the housing hole 76*b* is provided to the intermediate plate 28 in the case of a twin rotary compressor. With such a configuration, it is possible to suppress the depth, that is, the length in the axial direction, of the injection-check-valve actuation groove 77 and hence, it is possible to effectively discharge the compressed refrigerant. The fixing part 76 is not necessarily a bolt, and may be a rivet, for example.

The injection vertical hole 72 is opened and closed by the injection check valve 74, being a leaf spring. Excessive lifting of the injection check valve 74 is suppressed by the injection-check-valve-lift-amount control plate 75. An arc-shaped communicating part 73 is formed on the inner side of the injection-check-valve actuation groove 77 in the radial direction, the communicating part 73 making the injection vertical hole 72 and the compression chamber 23*a* communicate with each other. Therefore, the injection-check-valve actuation groove 77 communicates with the compression chamber 23*a* via the communicating part 73.

When the inside of the compression chamber 23*a* is lower than an injection pressure, injection refrigerant pushes up the injection check valve 74, and flows into the compression chamber 23*a*. Consequently, the flow rate of refrigerant compressed in and discharged from the cylinder 23 is increased by an amount corresponding to the injection refrigerant. When compression in the compression chamber

23*a* progresses, so that the pressure in the compression chamber 23*a* is high, the injection check valve 74 is seated on the end surface of the cylinder 23 in the height direction to close the injection vertical hole 72, thus preventing backflow of high-pressure refrigerant from the compression chamber 23*a* to the injection vertical hole 72.

Also in the case in which a plurality of cylinders 23 are provided instead of one cylinder 23, one injection mechanism is provided for each cylinder 23. To be more specific, the compression chambers 23*a* the number of which is equal to the number of cylinders 23 are provided, and an injection mechanism that injects intermediate-pressure refrigerant is provided to each compression chamber 23*a*. The constitutional elements of the injection mechanism according to Embodiment are the suction port 23*e*, the discharge valve 24*a*, the discharge port 24*b*, the injection lateral hole 70, the distal end hole 70*a*, the injection pipe connection part 71, the injection vertical hole 72, the communicating part 73, the injection check valve 74, the injection-check-valve-lift-amount control plate 75, the fixing part 76, and the injection-check-valve actuation groove 77.

In the compression chamber 23*a*, the actuations of suction, compression, and discharge are repeated and hence, refrigerant gas discharged from the discharge port 24*b* is intermittently discharged, thus causing noise, such as pulsation noise. To reduce such noise, as shown in FIG. 1, a discharge muffler 27 is attached on the outer side, that is, the electric motor 30 side, of the upper bearing 24 in such a way as to cover the upper bearing 24. The discharge muffler 27 has a discharge hole not shown in the drawing that makes the inside of the hermetic container 10 communicate with a space formed by the discharge muffler 27 and the upper bearing 24. The refrigerant gas discharged from the cylinder 23 via the discharge port 24*b* is first discharged to the space formed by the discharge muffler 27 and the upper bearing 24 and, thereafter, is discharged into the hermetic container 10 from the discharge hole.

As shown in FIG. 1, a suction muffler 101 is provided next to the hermetic container 10, the suction muffler 101 suppressing direct suction of liquid refrigerant into the compression chamber 23*a* of the cylinder 23. In general, low-pressure refrigerant gas and low-pressure liquid refrigerant are sent to the hermetic compressor 100 in a mixed state from an external circuit connected to the hermetic compressor 100. When liquid refrigerant flows into the cylinder 23, and is compressed by the compression mechanism part 20, the liquid refrigerant may cause a failure of the compression mechanism part 20. For this reason, the suction muffler 101 separates liquid refrigerant from refrigerant gas, and sends only the refrigerant gas to the compression chamber 23*a*. The suction muffler 101 is connected to the suction port 23*e* of the cylinder 23 by a suction coupling pipe 110, and low-pressure refrigerant gas sent from the suction muffler 101 is suctioned into the compression chamber 23*a* via the suction coupling pipe 110.

The compression mechanism part 20 has the above-mentioned configuration, and the eccentric shaft part 21*b* of the rotary shaft 21 rotates in the compression chamber 23*a* of the cylinder 23 due to the rotational motion of the rotary shaft 21. A working chamber is defined by the inner periphery of the compression chamber 23*a*, the outer periphery of the rolling piston 22 fitted on the eccentric shaft part 21*b*, and the vane 26, and the volume of the working chamber increases or decreases with the rotation of the rotary shaft 21. First, this working chamber and the suction port 23*e* communicate with each other, and low-pressure refrigerant gas is suctioned into the working chamber. Next, communication between the working chamber and the suction port 23*e* is cut, and the refrigerant gas in the working chamber is compressed with a decrease in volume of the working chamber. Lastly, the working chamber and the discharge port 24*b* are made to communicate with each other and, after the refrigerant gas in the working chamber reaches a predetermined pressure, the discharge valve 24*a* provided in the discharge port 24*b* is opened, so that the refrigerant gas is released to the outside of the working chamber, that is, to the outside of the compression chamber 23*a*, and thus high temperature and high pressure refrigerant gas is discharged. The high-temperature-and-high-pressure refrigerant gas discharged from the compression chamber 23*a* into the hermetic container 10 via the discharge muffler 27 passes through the electric motor 30, rises in the hermetic container 10, and is then discharged to the outside of the hermetic container 10 from a discharge pipe 102 provided at the upper part of the hermetic container 10. A refrigerant circuit through which refrigerant flows is formed outside the hermetic container 10, and discharged refrigerant cycles through the refrigerant circuit, and returns to the suction muffler 101 again.

Figure 7:
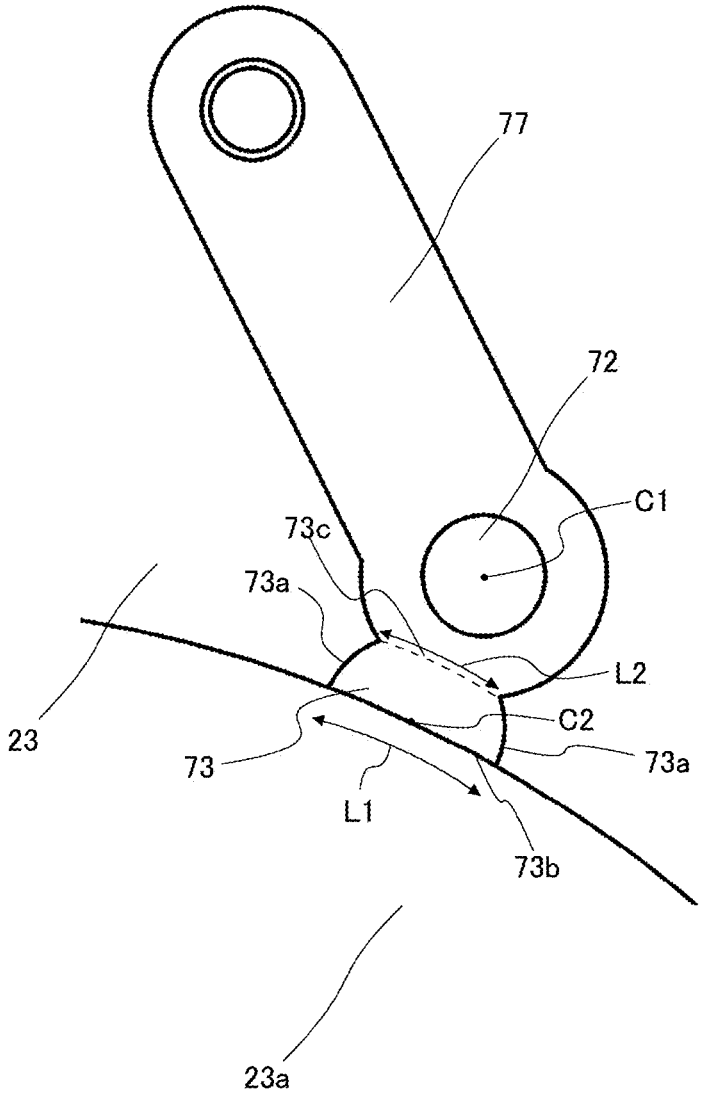
FIG. 7 is a schematic plan view showing, in an enlarged manner, an injection vertical hole and a communicating part of the hermetic compressor according to Embodiment, and an area around the injection vertical hole and the communicating part.
Figure 8:
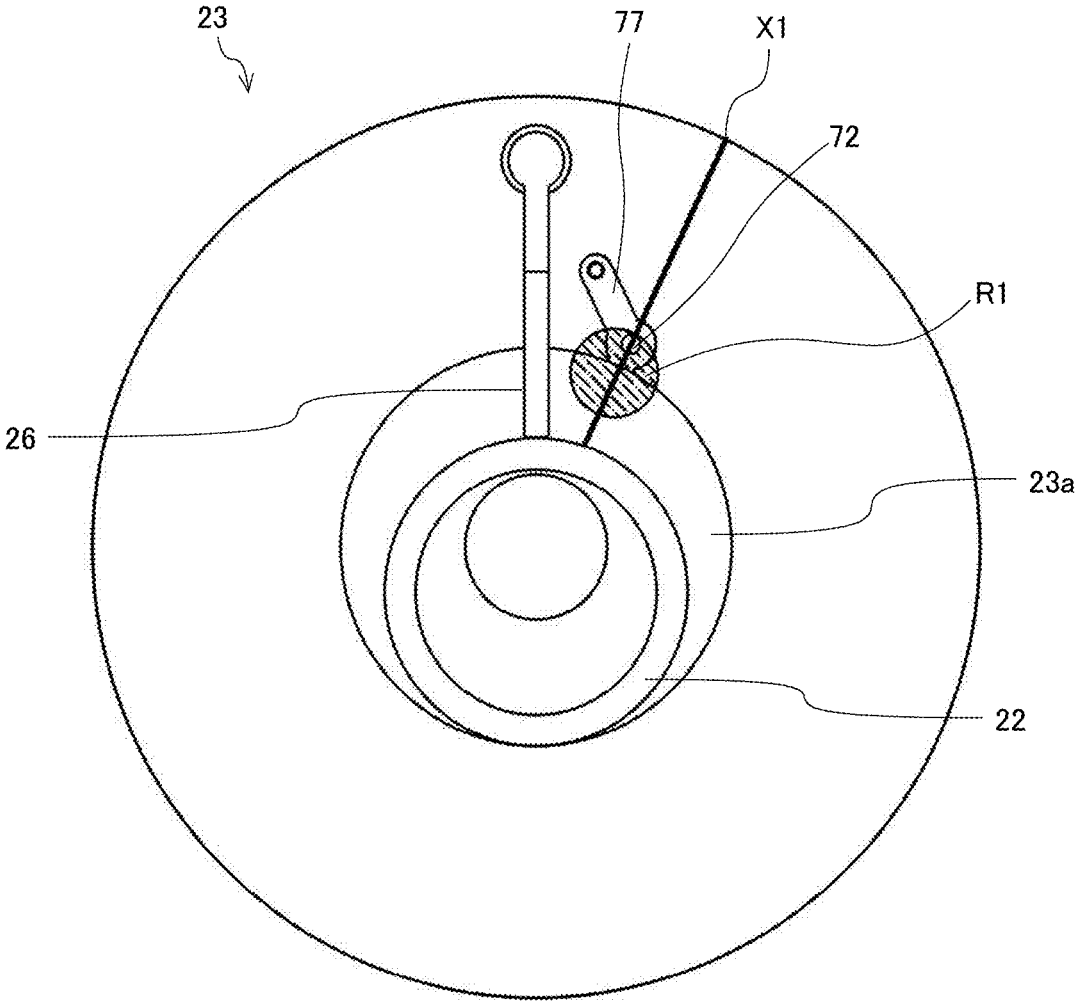
FIG. 8 is a schematic plan view showing a first region obtained by projecting a discharge port of the hermetic compressor according to Embodiment in the height direction of the cylinder.
Figure 9:
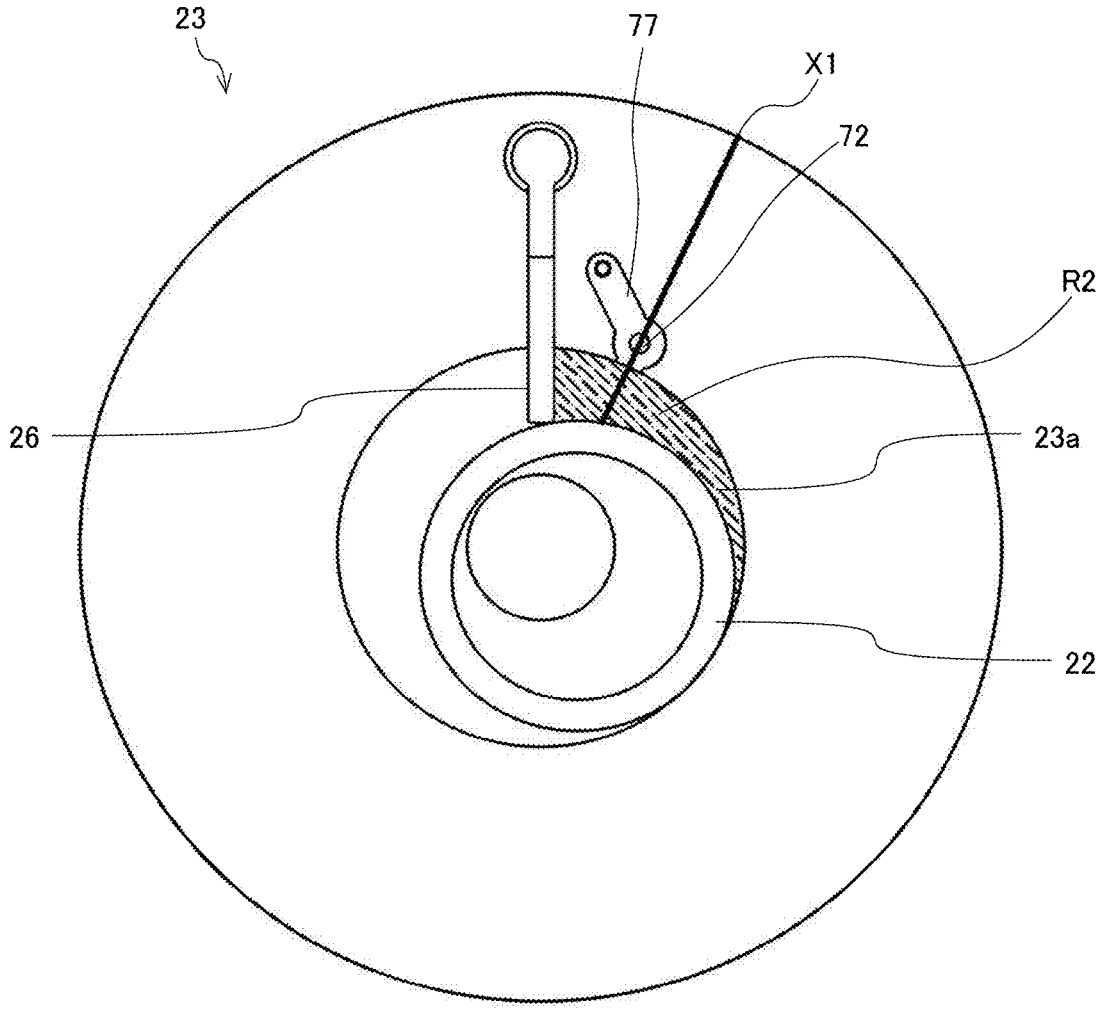
FIG. 9 is a schematic plan view showing a second region formed by the inner periphery of the cylinder of the hermetic compressor according to Embodiment, the outer periphery of a rolling piston, and a vane.
Figure 10:
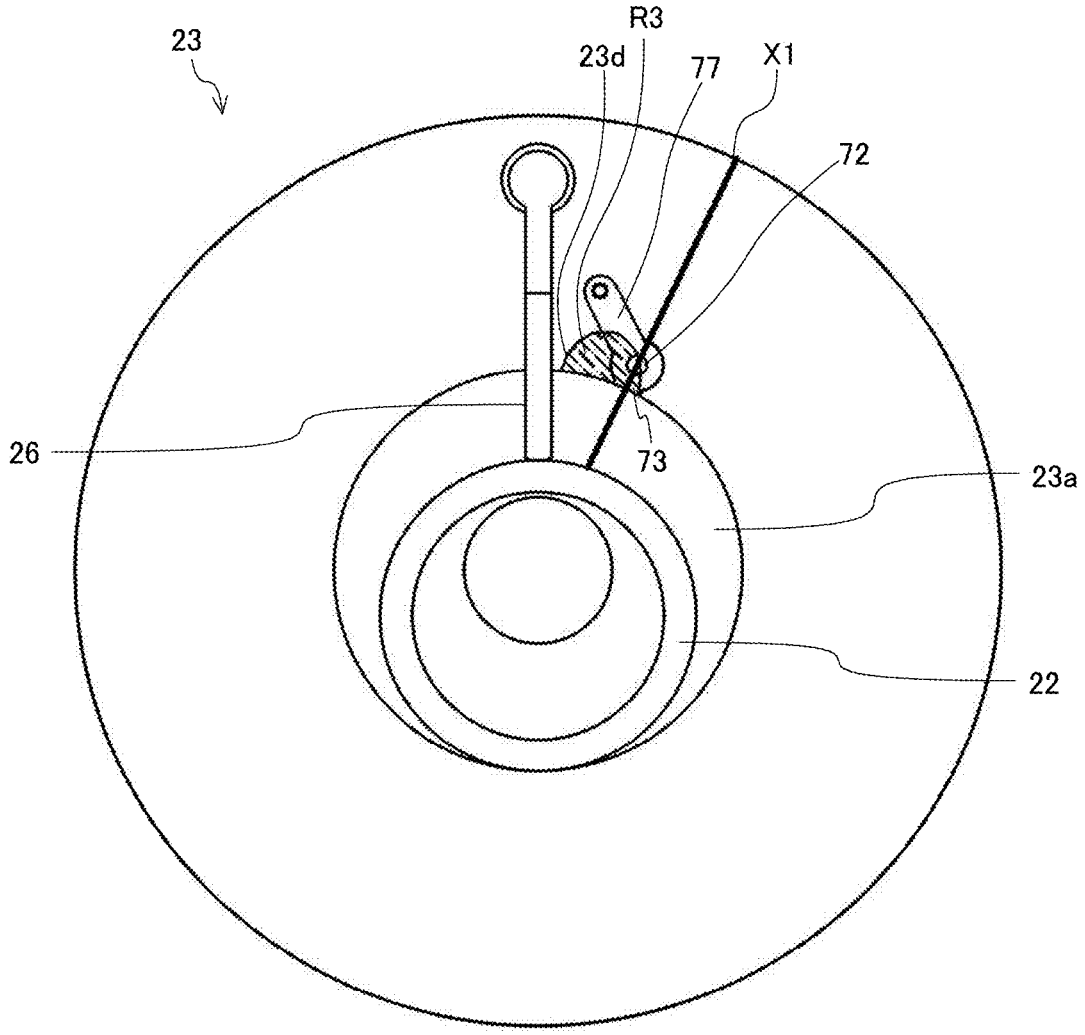
FIG. 10 is a schematic plan view showing a third region obtained by projecting a discharge cutout of the hermetic compressor according to Embodiment in the height direction of the cylinder.

FIG. 7 is a schematic plan view showing, in an enlarged manner, the injection vertical hole 72 and the communicating part 73 of the hermetic compressor 100 according to Embodiment, and an area around the injection vertical hole 72 and the communicating part 73. FIG. 8 is a schematic plan view showing a first region R1 obtained by projecting the discharge port 24*b* of the hermetic compressor 100 according to Embodiment in the height direction of the cylinder 23. FIG. 9 is a schematic plan view showing a second region R2 formed by the inner periphery of the cylinder 23 of the hermetic compressor 100 according to Embodiment, the outer periphery of the rolling piston 22, and the vane 26. FIG. 10 is a schematic plan view showing a third region R3 obtained by projecting the discharge cutout 23*d* of the hermetic compressor 100 according to Embodiment in the height direction of the cylinder 23.

As described above, one suction port 23*e* and one discharge port 24*b* are provided for each cylinder 23, and the suction port 23*e* and the discharge port 24*b* communicate with each other in one of revolution phases of the rolling piston 22. As shown in FIG. 3 and FIG. 7, the injection vertical hole 72 is disposed outward of the inner periphery of the cylinder 23. The communicating part 73 includes communicating-part wall surfaces 73*a* extending from positions close to the injection vertical hole 72 toward the inner periphery of the cylinder 23, that is, extending along the radial direction, the communicating-part wall surfaces 73*a* having an arc shape. Each communicating-part wall surface 73*a* has a shape that allows the communicating-part wall surface 73*a* to be easily processed by an end mill or the like and hence, it is possible to easily provide the communicating-part wall surfaces 73*a* by using the end mill or the like.

As shown in FIG. 7 and FIG. 8, in a plan view, a straight line X1 passes through the first region R1, which is obtained by projecting the discharge port 24*b* in the height direction of the cylinder 23, the straight line X1 connecting a center C1 of the injection vertical hole 72 and a center C2 of a boundary part 73*b* between the communicating part 73 and the inner periphery of the cylinder 23. The compressed high-temperature-and-high-pressure refrigerant passes through the first region R1 when discharged from the discharge port 24*b*. The injection vertical hole 72 and the communicating part 73 are disposed as described above and hence, relatively-low-temperature injection refrigerant passes through high-temperature portions in the first region R1 that is heated to a high temperature by the compressed high-temperature-and-high-pressure refrigerant passing through the first region R1 when discharged from the discharge port 24*b*, so that the high-temperature portions in the first region R1 are cooled. As a result, superheating of the high-temperature portions in the first region R1 is suppressed and hence, deterioration in reliability can be suppressed. In Embodiment, in components that constitute the compression mechanism part 20, including the cylinder 23, the rolling piston 22, the vane 26, the upper bearing 24, the lower bearing 25, and the intermediate plate 28, the high-temperature portions refer to portions of the components that reach high temperatures.

Alternatively, as shown in FIG. 7 and FIG. 9, in a plan view, the straight line X1 passes through a next second region R2, the straight line X1 connecting the center C1 of the injection vertical hole 72 and the center C2 of the boundary part 73*b* between the communicating part 73 and the inner periphery of the cylinder 23. The second region R2 is a region formed by the inner periphery of the cylinder 23, the outer periphery of the rolling piston 22, and the vane 26 in a phase of the rolling piston 22 in which an internal pressure Pc matches a discharge pressure Pd, the internal pressure Pc being the pressure of refrigerant in the compression chamber 23*a* of the cylinder 23, the discharge pressure Pd being the pressure of refrigerant discharged from the discharge port 24*b*. In the phase of the rolling piston 22 in which the internal pressure Pc, being the pressure of refrigerant in the compression chamber 23*a* of the cylinder 23, matches the discharge pressure Pd, being the pressure of refrigerant discharged from the discharge port 24*b*, the compressed high-temperature-and-high-pressure refrigerant is present in the second region R2. The injection vertical hole 72 and the communicating part 73 are disposed as described above and hence, relatively-low-temperature injection refrigerant passes through high-temperature portions in the second region R2 that is heated to a high temperature by the compressed high-temperature-and-high-pressure refrigerant, so that the high-temperature portions in the second region P2 are cooled. As a result, superheating of the high-temperature portions in the second region R2 is suppressed and hence, deterioration in reliability can be suppressed.

Alternatively, as shown in FIG. 7 and FIG. 10, the communicating part 73 and the discharge cutout 23*d* are disposed at positions that interfere with each other when the communicating part 73 and the discharge cutout 23*d* are projected on the same end surface of the cylinder 23 in the height direction. That is, the communicating part 73 and the discharge cutout 23*d* are disposed at positions that at least partially overlap with each other when the communicating part 73 and the discharge cutout 23*d* are projected on the same plane in the height direction. In this case, in a plan view, the straight line X1 passes through the third region P3, which is obtained by projecting the discharge cutout 23*d* in the height direction of the cylinder 23, the straight line X1 connecting the center C1 of the injection vertical hole 72 and the center C2 of the boundary part 73*b* between the communicating part 73 and the inner periphery of the cylinder 23. In the case in which the communicating part 73 and the discharge cutout 23*d* are disposed at positions that at least partially overlap with each other when the communicating part 73 and the discharge cutout 23*d* are projected on the same plane in the height direction, compressed high-temperature-and-high-pressure refrigerant passes through the third region R3 when discharged from the discharge port 24*b*. The injection vertical hole 72 and the communicating part 73 are disposed as described above and hence, relatively-low-temperature injection refrigerant passes through high-temperature portions in the third region R3 that is heated to a high temperature by the compressed high-temperature-and-high-pressure refrigerant passing through the third region R3 when discharged from the discharge port 24*b*, so that the high-temperature portions in the third region R3 is cooled. As a result, superheating of the high-temperature portions in the third region R3 is suppressed and hence, deterioration in reliability can be suppressed.

As shown in FIG. 7, the communicating part 73 is formed such that a width L1 (5 mm, for example) of the boundary part 73*b* between the communicating part 73 and the inner periphery of the cylinder 23 is larger than a width L2 (4 mm, for example) of a boundary part 73*c* between the communicating part 73 and the injection-check-valve actuation groove 77. By forming the communicating part 73 as described above such that the width L1 of the boundary part 73*b* is larger than the width L2 of the boundary part 73*c*, so that the width of the communicating part 73 increases along the direction in which injection refrigerant is injected, it is possible to inject the injection refrigerant at a wide angle, thus the above-mentioned high-temperature portions can be effectively cooled.

Figure 11:
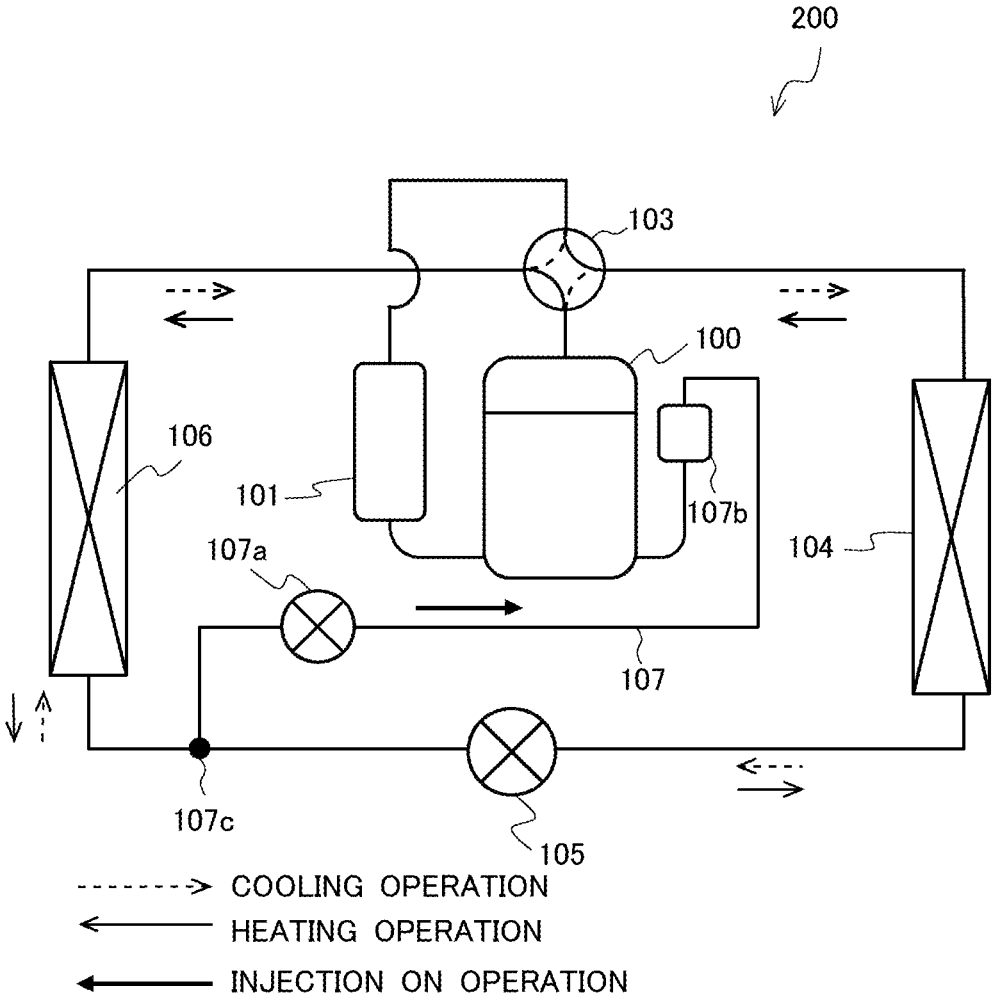
FIG. 11 is a schematic configuration diagram of a refrigeration cycle apparatus including the hermetic compressor according to Embodiment.

FIG. 11 is a schematic configuration diagram of a refrigeration cycle apparatus 200 including the hermetic compressor 100 according to Embodiment. Next, the refrigeration cycle apparatus 200 including the hermetic compressor 100 will be described with reference to FIG. 11. The refrigeration cycle apparatus 200 may be an air-conditioning apparatus, for example. The refrigeration cycle apparatus 200 includes the hermetic compressor 100, a flow passage switching valve 103, an outdoor heat exchanger 104, a pressure reducer 105, and an indoor heat exchanger 106, the hermetic compressor 100 including the suction muffler 101 connected to the suction side of the hermetic compressor 100, the flow passage switching valve 103 being connected to the discharge side of the hermetic compressor 100. These components are sequentially connected to each other via pipes, thus forming a main circuit of the refrigerant circuit through which refrigerant cycles. The refrigerant circuit is also provided with the injection pipe 107 branched from a branch point 107*c* and connected to the compression mechanism part 20 of the hermetic compressor 100, the branch point 107*c* being located between the pressure reducer 105 and the indoor heat exchanger 106 of the main circuit. An injection pressure reducer 107*a* and an injection muffler 107*b* are provided at intermediate portions of the injection pipe 107, the injection pressure reducer 107*a* adjusting injection pressure and flow rate, the injection muffler 107*b* straightening the flow of refrigerant. The injection pressure reducer 107*a* may also serve as a device that switches ON/OFF of injection, or a solenoid valve may be additionally provided to the injection pipe 107, and ON/OFF of injection may be switched by this solenoid valve.

The flow passage switching valve 103 is, for example, a four-way valve, and switches the operation between a cooling operation and a heating operation by switching the direction of the flow of refrigerant. For the flow passage switching valve 103, a combination of a two-way valve and a three-way valve may be used instead of the four-way valve. The pressure reducer 105 expands refrigerant by reducing the pressure of the refrigerant. The pressure reducer 105 is, for example, an electronic expansion valve that allows adjustment of the throttle opening degree thereof. The pressure reducer 105 adjusts the opening degree thereof to control the pressure of refrigerant flowing into the indoor heat exchanger 106 during the cooling operation, whereas the pressure reducer 105 adjusts the opening degree thereof to control the pressure of refrigerant flowing into the outdoor heat exchanger 104 during the heating operation. The outdoor heat exchanger 104 serves as an evaporator or a condenser, and performs heat exchange between air and refrigerant to evaporate and gasify the refrigerant or to condense and liquify the refrigerant. The outdoor heat exchanger 104 serves as the evaporator during the heating operation, whereas serves as the condenser during the cooling operation. The indoor heat exchanger 106 serves as an evaporator or a condenser, and performs heat exchange between air and refrigerant to evaporate and gasify the refrigerant or to condense and liquify the refrigerant. The indoor heat exchanger 106 serves as the condenser during the heating operation, whereas serves as the evaporator during the cooling operation.

In the case of the heating operation, the flow passage switching valve 103 is connected as shown by solid lines in FIG. 11. High-temperature-and-high-pressure refrigerant compressed by the hermetic compressor 100 flows into the indoor heat exchanger 106, and is then condensed and liquified and, thereafter, is throttled by the pressure reducer 105, thus being brought into a low temperature and low pressure two phase state. Then, the refrigerant flows into the outdoor heat exchanger 104, and is then evaporated and gasified and, thereafter, passes through the flow passage switching valve 103 to return to the hermetic compressor 100 again. That is, refrigerant cycles as shown by solid line arrows in FIG. 11. Due to this cycle, in the outdoor heat exchanger 104 serving as the evaporator, the refrigerant that is sent to the outdoor heat exchanger 104 performs heat exchange with outside air to absorb heat. Then, the refrigerant that is subjected to heat absorption is sent to the indoor heat exchanger 106, serving as the condenser, to perform heat exchange with indoor air, thus heating the indoor air.

In the case of further increasing heating capacity in the heating operation, or in the case of an operation condition in which there is a large difference between a suction pressure and a discharge pressure, and high temperature portions are unevenly distributed in the compression mechanism part 20, relatively-low-temperature refrigerant that is subjected to heat exchange with indoor air by the indoor heat exchanger 106 is caused to flow into the injection pipe 107 by opening the valve of the injection pressure reducer 107*a* (see bold solid line arrow in FIG. 11). The outlet of the injection pipe 107 is connected to the compression mechanism part 20 of the hermetic compressor 100 and hence, the relatively low temperature refrigerant that flows into the injection pipe 107 flows into the compression mechanism part 20 of the hermetic compressor 100 as injection refrigerant. The injection refrigerant that flows into the compression mechanism part 20 is compressed together with low pressure refrigerant that flows into the suction muffler 101 from the main circuit, and the refrigerant is discharged as high-temperature-and-high-pressure refrigerant gas from the hermetic compressor 100.

In the case of the cooling operation, the flow passage switching valve 103 is connected as shown by broken lines in FIG. 11. High-temperature-and-high-pressure refrigerant compressed by the hermetic compressor 100 flows into the outdoor heat exchanger 104, and is then condensed and liquified and, thereafter, is throttled by the pressure reducer 105, thus being brought into a low temperature and low pressure two phase state. Then, the refrigerant flows into the indoor heat exchanger 106, and is then evaporated and gasified and, thereafter, passes through the flow passage switching valve 103 to return to the hermetic compressor 100 again. That is, when the operation is changed from the heating operation to the cooling operation, the indoor heat exchanger 106 is changed from the condenser to the evaporator, and the outdoor heat exchanger 104 is changed from the evaporator to the condenser Thus, the refrigerant cycles as shown by broken line arrows in FIG. 11. Due to this cycle, in the indoor heat exchanger 106 serving as the evaporator, the refrigerant performs heat exchange with indoor air to absorb heat from the indoor air, that is, to cool the indoor air. The refrigerant that is subjected to heat absorption is sent to the outdoor heat exchanger 104 serving as the condenser to perform heat exchange with outside air, thus transferring heat to the outside air.

As has been described above, the hermetic compressor 100 according to Embodiment includes: the cylinder 23 including the compression chamber 23*a*, the injection vertical hole 72, and the communicating part 73, refrigerant being compressed in the compression chamber 23*a*, the injection vertical hole 72 extending in the height direction and constituting a portion of the injection flow passage through which the refrigerant is supplied into the compression chamber 23*a*, the communicating part 73 being configured to make the injection vertical hole 72 and the compression chamber 23*a* communicate with each other; and the closing parts fixed to both end surfaces of the cylinder 23 in the height direction to close the compression chamber 23*a*, wherein the closing part that is fixed to one end surface of the cylinder 23 has the discharge port 24*b* through which the refrigerant compressed is discharged to the outside of the compression chamber 23*a* and, in a plan view, the straight line X1 passes through the region obtained by projecting the discharge port 24*b* in the height direction of the cylinder 23, the straight line X1 connecting the center C1 of the injection vertical hole 72 and the center C2 of the boundary part 73*b* between the communicating part 73 and the inner periphery of the cylinder 23.

The hermetic compressor 100 according to Embodiment includes: the electric motor 30 including the stator 31 and the rotor 32; the cylinder 23 including the compression chamber 23*a*, the injection vertical hole 72, and the communicating part 73, refrigerant being compressed in the compression chamber 23*a*, the injection vertical hole 72 extending in the height direction and constituting a portion of the injection flow passage through which the refrigerant is supplied into the compression chamber 23*a*, the communicating part 73 being configured to make the injection vertical hole 72 and the compression chamber 23*a* communicate with each other; the rotary shaft 21 provided in the compression chamber 23*a*, including the eccentric shaft part 21*b*, and configured to be rotated by the electric motor 30, the eccentric shaft part 21*b* being configured to perform an eccentric motion in the compression chamber 23*a*; the rolling piston 22 provided to the eccentric shaft part 21*b*; the vane 26 configured to partition the space formed by the inner periphery of the cylinder 23 and the outer periphery of the rolling piston 22 into the suction-side space and the compression-side space; and the closing parts fixed to both end surfaces of the cylinder 23 in the height direction to close the compression chamber 23*a*, wherein the closing part that is fixed to one end surface of the cylinder 23 has the discharge port 24*b* through which the refrigerant compressed is discharged to the outside of the compression chamber 23*a*, and in the phase of the rolling piston 22 in which the pressure of refrigerant in the compression chamber 23*a* matches the pressure of refrigerant discharged from the discharge port 24*b*, in a plan view, the straight line X1 passes through the region formed by the inner periphery of the cylinder 23, the outer periphery of the rolling piston 22, and the vane 26, the straight line X1 connecting the center C1 of the injection vertical hole 72 and the center C2 of the boundary part 73*b* between the communicating part 73 and the inner periphery of the cylinder 23.

Alternatively, the hermetic compressor 100 according to Embodiment includes: the cylinder 23 including the compression chamber 23*a*, the injection vertical hole 72, and the communicating part 73, refrigerant being compressed in the compression chamber 23*a*, the injection vertical hole 72 extending in the height direction and constituting a portion of the injection flow passage through which the refrigerant is supplied into the compression chamber 23*a*, the communicating part 73 being configured to make the injection vertical hole 72 and the compression chamber 23*a* communicate with each other; and the closing parts fixed to both end surfaces of the cylinder 23 in the height direction to close the compression chamber 23*a*, wherein the closing part that is fixed to one end surface of the cylinder 23 has the discharge port 24*b* through which the refrigerant compressed is discharged to the outside of the compression chamber 23*a*, the discharge cutout 23*d* is formed by cutting out a portion of the one end surface of the cylinder 23 at a position close to the inner periphery of the cylinder 23, and in the case in which the communicating part 73 and the discharge cutout 23*d* are disposed at positions that at least partially overlap with each other when the communicating part 73 and the discharge cutout 23*d* are projected on the same plane in the height direction, in a plan view, the straight line X1 passes through the region obtained by projecting the discharge cutout 23*d* in the height direction of the cylinder 23, the straight line X1 connecting the center C1 of the injection vertical hole 72 and the center C2 of the boundary part 73*b* between the communicating part 73 and the inner periphery of the cylinder 23.

In the hermetic compressor 100 according to Embodiment, the cylinder 23 includes the injection vertical hole 72, which forms a portion of the injection flow passage, and the communicating part 73 and, in a plan view, the straight line X1 passes through the region obtained by projecting the discharge port 24*b* in the height direction of the cylinder 23, the straight line X1 connecting the center C1 of the injection vertical hole 72 and the center C2 of the boundary part 73*b* between the communicating part 73 and the inner periphery of the cylinder 23, or the straight line X1 passes through the region formed by the inner periphery of the cylinder 23, the outer periphery of the rolling piston 22, and the vane 26 in the phase of the rolling piston 22 in which the pressure of refrigerant in the compression chamber 23*a* matches the pressure of refrigerant discharged from the discharge port 24*b*, or the straight line X1 passes through the region obtained by projecting the discharge cutout 23*d* in the height direction of the cylinder 23 in the case in which the communicating part 73 and the discharge cutout 23*d* are disposed at positions that at least partially overlap with each other when the communicating part 73 and the discharge cutout 23*d* are projected on the same plane in the height direction. The injection vertical hole 72 and the communicating part 73 are disposed as described above and hence, relatively-low-temperature injection refrigerant passes through the high-temperature portions in the region that is heated to a high temperature by the compressed high-temperature-and-high-pressure refrigerant, so that the high-temperature portions are cooled. As a result, superheating of the high-temperature portions is suppressed and hence, deterioration in reliability can be suppressed.

The hermetic compressor 100 according to Embodiment includes the injection check valve 74 that opens and closes the injection vertical hole 72, wherein the other end surface of the cylinder 23 in the height direction has the injection-check-valve actuation groove 77 in which the injection check valve 74 is disposed and, in a plan view, the width L1 of the boundary part 73*b* between the communicating part 73 and the inner periphery of the cylinder 23 is larger than the width L2 of the boundary part 73*c* between the communicating part 73 and the injection-check-valve actuation groove 77.

In the hermetic compressor 100 according to Embodiment, the width L1 of the boundary part 73*b* is larger than the width L2 of the boundary part 73*c*, so that the communicating part 73 is formed such that the width of the communicating part 73 increases along the direction in which injection refrigerant is injected. Accordingly, the injection refrigerant can be injected at a wide angle, thus the high-temperature portions can be effectively cooled.

In the hermetic compressor 100 according to Embodiment, in a plan view, the communicating part 73 has the communicating-part wall surface 73*a* extending along the radial direction, the communicating-part wall surface 73*a* having an arc shape.

In the hermetic compressor 100 according to Embodiment, each communicating-part wall surface 73*a* of the communicating part 73 has a shape that allows the communicating-part wall surface 73*a* to be easily processed by an end mill or the like. Accordingly, it is possible to easily provide the communicating-part wall surfaces 73*a* by using the end mill or the like.

The present application is not limited to the above-described Embodiment as it is, and can be embodied by applying a modification to constitutional elements in the implementation stage without departing from the gist of the present application. Further, a plurality of constitutional elements disclosed in the above-described Embodiment may be suitably used in combination.

REFERENCE SIGNS LIST

10: hermetic container, 10*a*: bottom part, 11: upper container, 12: lower container, 20: compression mechanism part, 21: rotary shaft, 21*a*: main shaft part, 21*b*: eccentric shaft part, 21*c*: sub-shaft part, 22: rolling piston, 23: cylinder, 23*a*: compression chamber, 23*b*: back pressure chamber, 23*c*: vane groove, 23*d*: discharge cutout, 23*e*: suction port, 24: upper bearing, 24*a*: discharge valve, 24*b*: discharge port, 25: lower bearing, 26: vane, 27: discharge muffler, 28: intermediate plate, 30: electric motor, 31: stator, 32: rotor, 70: injection lateral hole, 70*a*: distal end hole, 71: injection pipe connection part, 72: injection vertical hole, 73: communicating part, 73*a*: communicating-part wall surface, 73*b*: boundary part, 73*c*: boundary part, 74: injection check valve, 75: injection-check-valve-lift-amount control plate, 76: fixing part, 76*a*: head part, 76*b*: housing hole, 77: injection-check-valve actuation groove, 100: hermetic compressor, 101: suction muffler, 102: discharge pipe, 103: flow passage switching valve, 104: outdoor heat exchanger, 105: pressure reducer, 106: indoor heat exchanger, 107: injection pipe, 107*a*: injection pressure reducer, 107*b*: injection muffler, 107*c*: branch point, 110: suction coupling pipe, 200: refrigeration cycle apparatus.

The invention claimed is:

1. A hermetic compressor comprising:

a cylinder including a compression chamber, an injection vertical hole, and a communicating part, refrigerant being compressed in the compression chamber, the injection vertical hole extending in a height direction and constituting a portion of an injection flow passage through which the refrigerant is supplied into the compression chamber, the communicating part being configured to make the injection vertical hole and the compression chamber communicate with each other; and closing parts fixed to both end surfaces of the cylinder in the height direction to close the compression chamber, wherein a closing part of the closing parts that is fixed to one end surface of both end surfaces of the cylinder has a discharge port through which the refrigerant compressed is discharged to an outside of the compression chamber, in a plan view, a straight line passes through a region obtained by projecting the discharge port in the height direction of the cylinder, the straight line connecting a center of the injection vertical hole and a center of a boundary part between the communicating part and an inner periphery of the cylinder, the hermetic compressor further comprises an injection check valve configured to open and close the injection vertical hole, another end surface of both end surfaces of the cylinder in the height direction has an injection check valve actuation groove in which the injection check valve is disposed, in a plan view, a width of the boundary part between the communicating part and the inner periphery of the cylinder is larger than a width of a boundary part between the communicating part and the injection check valve actuation groove, and in a plan view, the communicating part has a communicating-part wall surface extending along a radial direction, the communicating-part wall surface having an arc shape.

2. A hermetic compressor comprising:

an electric motor including a stator and a rotor;

a cylinder including a compression chamber, an injection vertical hole, and a communicating part, refrigerant being compressed in the compression chamber, the injection vertical hole extending in a height direction and constituting a portion of an injection flow passage through which the refrigerant is supplied into the compression chamber, the communicating part being configured to make the injection vertical hole and the compression chamber communicate with each other;

a rotary shaft provided in the compression chamber, including an eccentric shaft part, and configured to be rotated by the electric motor, the eccentric shaft part being configured to perform an eccentric motion in the compression chamber;

a rolling piston provided to the eccentric shaft part;

a vane configured to partition a space formed by an inner periphery of the cylinder and an outer periphery of the rolling piston into a suction-side space and a compression-side space; and closing parts fixed to both end surfaces of the cylinder in the height direction to close the compression chamber, wherein a closing part of the closing parts that is fixed to one end surface of both end surfaces of the cylinder has a discharge port through which the refrigerant compressed is discharged to an outside of the compression chamber, in a phase of the rolling piston in which a pressure of refrigerant in the compression chamber matches a pressure of refrigerant discharged from the discharge port, in a plan view, a straight line passes through a region formed by the inner periphery of the cylinder, the outer periphery of the rolling piston, and the vane, the straight line connecting a center of the injection vertical hole and a center of a boundary part between the communicating part and the inner periphery of the cylinder, the hermetic compressor further comprises an injection check valve configured to open and close the injection vertical hole, another end surface of both end surfaces of the cylinder in the height direction has an injection check valve actuation groove which the injection check valve is disposed, in a plan view, a width of the boundary part between the communicating part and the inner periphery of the cylinder is larger than a width of a boundary part between the communicating part and the injection check valve actuation groove, and in a plan view, the communicating part has a communicating-part wall surface extending along a radial direction, the communicating-part wall surface having an arc shape.

3. A hermetic compressor comprising:

a cylinder including a compression chamber, an injection vertical hole, and a communicating part, refrigerant being compressed in the compression chamber, the injection vertical hole extending in a height direction and constituting a portion of an injection flow passage through which the refrigerant is supplied into the compression chamber, the communicating part being configured to make the injection vertical hole and the compression chamber communicate with each other; and closing parts fixed to both end surfaces of the cylinder in the height direction to close the compression chamber, wherein a closing part of the closing parts that is fixed to one end surface of both end surfaces of the cylinder has a discharge port through which the refrigerant compressed is discharged to an outside of the compression chamber, a discharge cutout is formed by cutting out a portion of the one end surface of the cylinder at a position close to an inner periphery of the cylinder, in a case in which the communicating part and the discharge cutout are disposed at positions that at least partially overlap with each other when the communicating part and the discharge cutout are projected on a same plane in the height direction, in a plan view, a straight line passes through a region obtained by projecting the discharge cutout in the height direction of the cylinder, the straight line connecting a center of the injection vertical hole and a center of a boundary part between the communicating part and the inner periphery of the cylinder, the hermetic compressor further comprises an injection check valve configured to open and close the injection vertical hole, another end surface of both end surfaces of the cylinder in the height direction has an injection check valve actuation groove in which the injection check valve is disposed, in a plan view, a width of the boundary part between the communicating part and the inner periphery of the cylinder is larger than a width of a boundary part between the communicating part and the injection check valve actuation groove, and in a plan view, the communicating part has a communicating-part wall surface extending along a radial direction, the communicating-part wall surface having an arc shape.

4. A refrigeration cycle apparatus comprising the hermetic compressor of claim 1.

5. A refrigeration cycle apparatus comprising the hermetic compressor of claim 2.

6. A refrigeration cycle apparatus comprising the hermetic compressor of claim 3.

* * * * *